United States Patent [19]

Gibson et al.

[11] 4,367,877

[45] Jan. 11, 1983

[54] PUTTER

[75] Inventors: Ronald F. Gibson, 811-4th Ave. N., Kent, Wash. 98031; Hendrick W. Haynes, Seattle, Wash.

[73] Assignee: Ronald F. Gibson, Kent, Wash.

[21] Appl. No.: 63,335

[22] Filed: Aug. 2, 1979

[51] Int. Cl.[3] ..... A63B 53/04

[52] U.S. Cl. ..... 273/164; 273/183 D

[58] Field of Search ..... 273/77 R, 163 R, 164, 273/183 D, 193 R, 194 R

[56] References Cited

U.S. PATENT DOCUMENTS

| | | | |
|---|---|---|---|
| D. 234,782 | 4/1975 | Creed | 273/163 R X |
| D. 239,637 | 4/1976 | Loggins | 273/164 X |
| D. 247,585 | 3/1978 | Duclos | 273/164 X |
| 2,463,798 | 3/1949 | Paisley | 273/163 R |
| 2,781,197 | 2/1967 | Wiley | 273/164 |
| 2,991,082 | 7/1961 | Handzlik | 273/164 |
| 3,043,596 | 7/1962 | Ehmke | 273/163 R |
| 3,273,891 | 9/1966 | Grim | 273/183 D |
| 3,408,074 | 10/1968 | Antonious | 273/164 |
| 3,700,244 | 10/1972 | Liotta | 273/193 R X |
| 3,880,430 | 4/1975 | McCabe | 273/183 D |
| 4,043,562 | 8/1977 | Shillington | 273/164 |
| 4,231,576 | 11/1980 | Perkins | 273/183 D |

FOREIGN PATENT DOCUMENTS

| | | | |
|---|---|---|---|
| 52-15733 | 2/1977 | Japan | 273/163 R |

*Primary Examiner*—Richard J. Apley

*Attorney, Agent, or Firm*—Harvey B. Jacobson

[57] ABSTRACT

A putter uses an angled mirrored upper club surface with a deeply scribed and pigment filled line to act as a sighting device. In one embodiment, a clear plastic block has a bottom surface coated with a highly reflective coating. A pair of lines are scribed on upper and lower surfaces of the block and must be aligned while the target is sighted in the mirrored surface. Other embodiments utilize deep grooves formed in the top of a mirrored or unmirrored club surface.

5 Claims, 10 Drawing Figures

Fig. 5
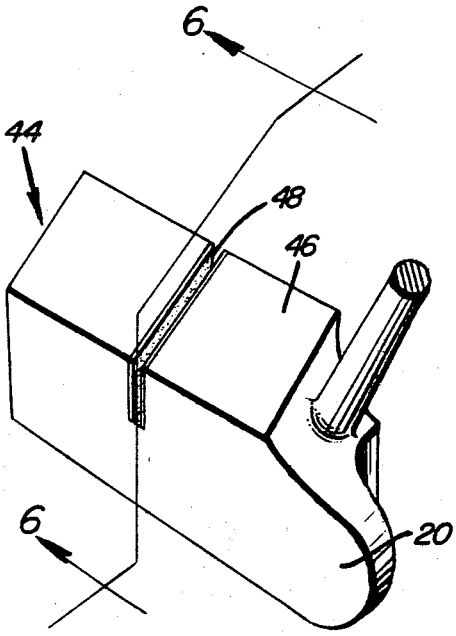
Fig. 6
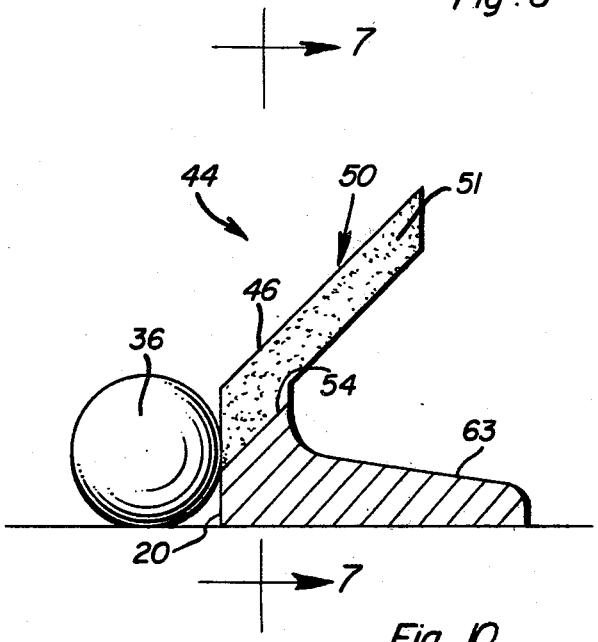
Fig. 9
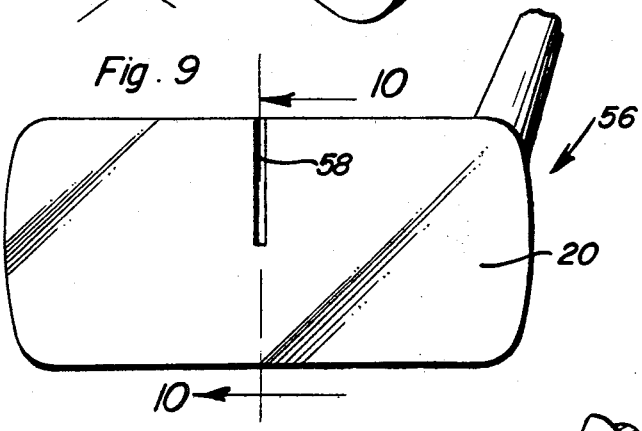
Fig. 10
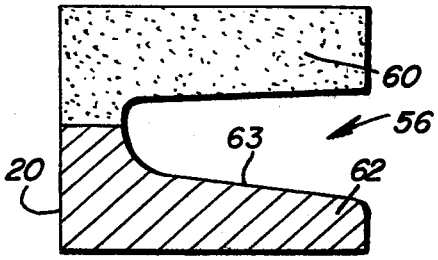
Fig. 7
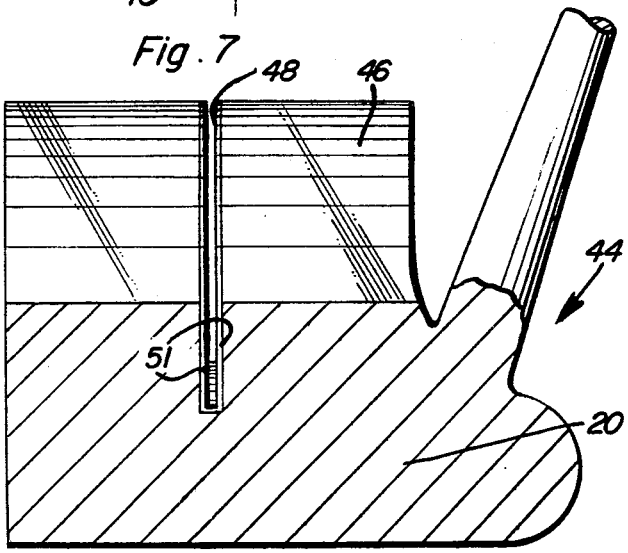
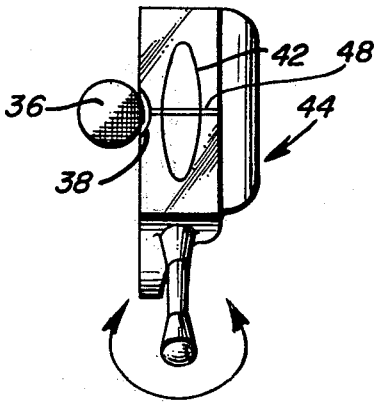
Fig. 8

PUTTER

BACKGROUND OF THE INVENTION

1. Field of the Invention

The present invention relates to golf clubs and more particularly to golf clubs having sighting means for accurately aligning the club head with the golf ball to be struck and the hole which acts as a target.

2. Discussion of Related Art

A standard golf putter consists basically of a grip region for the hands of the user to maintain a steady hold on the club, a shaft to transmit the user's swing energy to the ball, and a club head through which momentum is transmitted on impact to the object ball. The shaft is mounted to one side of the club head, and the device is aimed by the user's standing erect and judging the distance and terrain to the object "hole", lining up the face of the putter normally to the intended ball driving axis, and having a controlled swing culminating in impacting the ball and sending it along its intended path. Judging the putter's head angle is often difficult, even to someome skilled in its use, as a longer putt of several tens of feet or meters requires putting surface face angle judgment in terms of minutes of arc-angle. Not only must the putter user objectively define target distance, direction and terrain, but he must translate that information to the club head by looking up and ahead, looking down at the club head at his or her feet, and looking ahead, this culminating in impacting the ball along a planned trajectory.

Several putters are available with modified striking heads, which are oriented primarily to allow a square and direct impact with the ball. One such putter has an arrow pointing in the direction of the swing, the arrow being printed on the top of the club head to aid in both directing the swing and in gauging the impact point of the ball with the club face.

U.S. Pat. No. 1,327,171, issued Jan. 6, 1920 to Ruggles, shows a golf putter with an angled mirrored surface for aiming the putter head at the object hole or "cup". U.S. Pat. No. 1,555,062, issued Oct. 6, 1925 to Baugh, discloses a putter which is aimed by aligning cross hairs in a 90° angle of a viewing device comprising an upper lens with cross hairs disposed thereon, an angled mirror, and a front vertically aligned lens with cross hairs. Alignment with the cup is accomplished only in a vertical rotational axis. U.S. Pat. No. 2,463,789, issued Mar. 8, 1949 to Paisley, describes a putter having two mirrored surfaces. One mirror contains a sighting line for targeting the alignment of the putter face with the cup in a vertical rotational axis. The second mirror is provided to establish alignment in a horizontal rotational axis. This mirror is mounted behind the putter head in a position substantially normal to the putting face. U.S. Pat. No. 3,880,430, issued Apr. 29, 1975 to McCabe, discloses a putting club head that utilizes various alignment marks located normal and/or parallel to the club face and to the viewer's normal line of vision, so as to establish club alignment relative to vertical and horizontal rotational axes. The following design patents also show golf putters having alignment means for the heads: U.S. Pat. No. D. 233,533, issued Nov. 5, 1974 to Carban; U.S. Pat. No. D. 239,637, issued Apr. 20, 1976 to Loggins; and U.S. Pat. No. D. 245,439, issued Aug. 16, 1977 to Thiel.

SUMMARY OF THE INVENTION

One object of the present invention is to provide a golf putter which allows the golfer to sight easily down substantially flat terrain by looking at the reflection of the object hole and the ground between the putter and the hole, and by lining up a precision sight line with the objective hole and applying controlled swing by which the ball may be putted in a more highly controlled manner.

Another object of the present invention is to provide a golf putter which enhances the ability of the novice at the game of golf to attain a proper stance while putting.

The above objects are accomplished by the provision of marks or a slot on the head of a putter, which marks or slots are in a single vertical plane. A surface plane which intersects the vertical plane is angled at between 10°-80° with respect to the club bottom and rides with a substantially uniform pitch with respect to the putter face. A surface is mirrored to aid in aiming the putter head at the target. By aligning the grooves or sighting down the slot and centering the grooves or slot on the golf ball at the same time as aiming the ball at the target hole through use of the mirrored plane, complete 3-dimensional alignment of the head can be attained.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a perspective view of a second embodiment of a putter according to the present invention.

FIG. 6 is a side elevational sectional view taken substantially along a plane passing through section line 6—6 of FIG. 5.

FIG. 7 is a front elevational sectional view taken substantially along a plane passing through section line 7—7 of FIG. 6.

FIG. 8 is a top plan view showing the putter head alignment using the putter of FIG. 5.

FIG. 9 is a front elevational view of a putter made according to the present invention without a mirrored surface.

FIG. 10 is a side elevational sectional view taken substantially along a plane passing through section line 10—10 of FIG. 9.

DESCRIPTION OF THE PREFERRED EMBODIMENT

Figure 1:
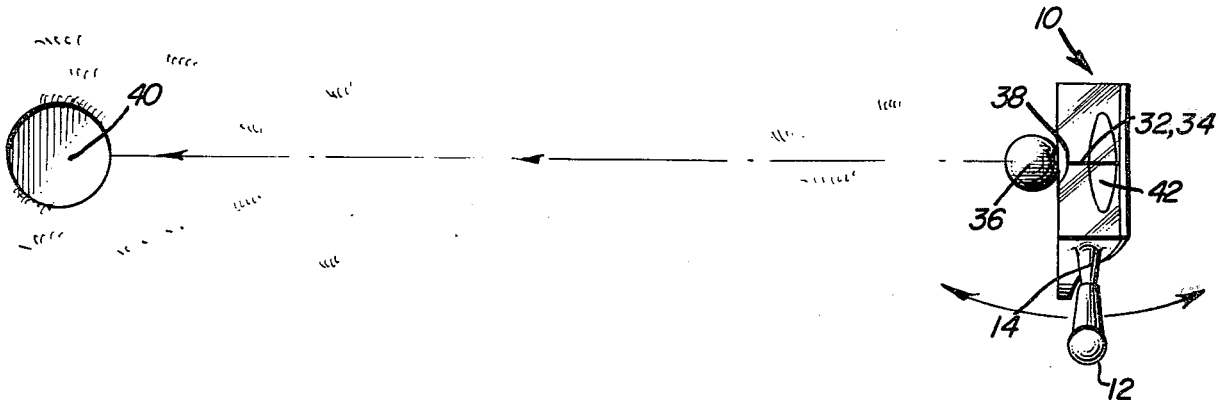
FIG. 1 is a top plan view showing a use of a golf putter forming the present invention.
Figure 2:
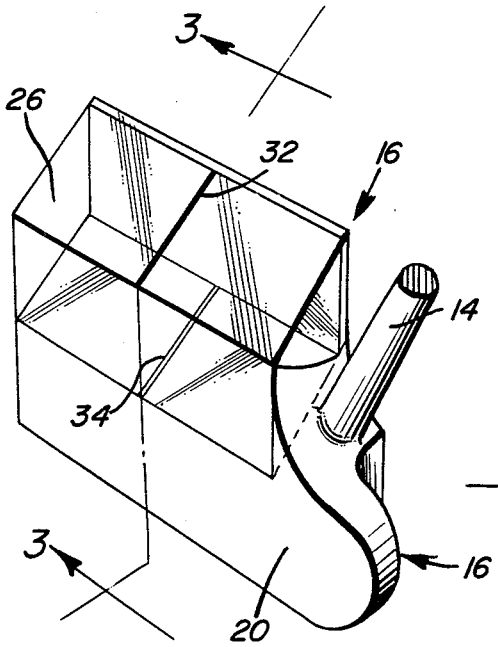
FIG. 2 is a perspective view of the putter of the present invention.
Figure 3:
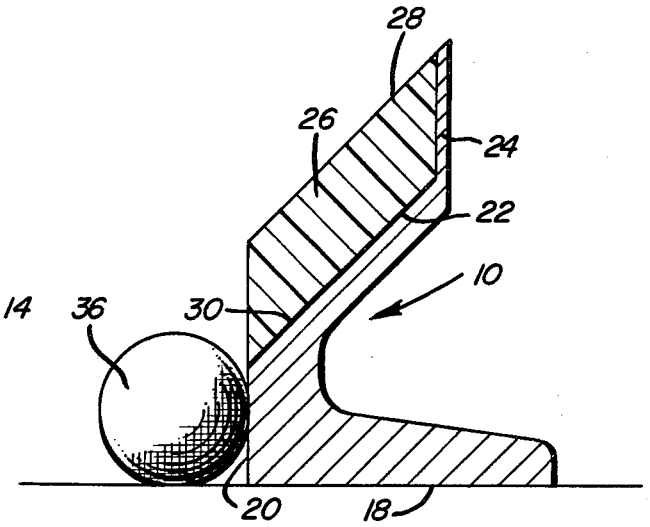
FIG. 3 is a side elevational sectional view taken substantially along a plane passing through section line 3—3 of FIG. 2.
Figure 4:
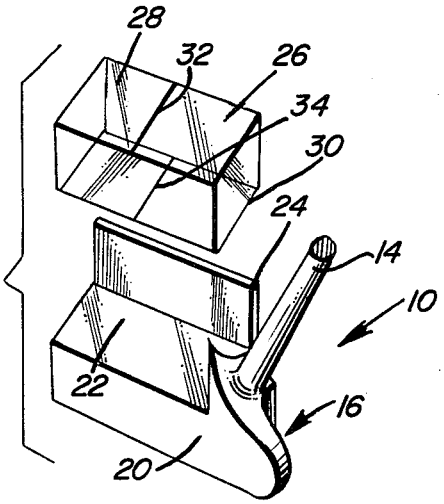
FIG. 4 is an exploded perspective view of the putter of the present invention.

Now with reference to the drawings, a putter incorporating the principles and concepts of the present invention and generally referred to by the reference numeral 10 will be described in detail. With particular reference to FIGS. 1-4, it will be seen that putter 10 consists of a grip 12 attached to a long depending shaft 14 which terminates in a club head 16. Head 16 can be attached to shaft 14 through any conventional means. The head 16 has a bottom surface 18 which is substantially planar and designed to lie flat on the ground. The bottom surface 18 is substantially normal to a front striking surface 20 which is designed to be positioned in a vertical plane when the clubhead is positioned on the ground as shown. An angled surface 22 is formed in the club head and extends upwardly and rearwardly from the striking surface 20. The putter is also shown to include an upstanding rear wall 24 which acts with surface 22 to define a notch receiving clear plastic block 26. Block 26 can be produced from any suitable transparent material and must contain upper and lower parallel surfaces 28 and 30. Surface 30 rests on surface 22 and is attached thereto by any suitable means. The upper surface 28 of block 26 contains an optical line 32 placed thereon by any suitable means such as scribing or marking. Line 32 is formed in the plane of the surface 28 and extends normally to the striking surface 20 of the club head. In like manner, a second line 34 is formed in the bottom surface 30 of the block 28 and extends parallel to line 32. Lines 32 and 34 are alignable to define a plane which extends perpendicular to the club face 20. Furthermore, the bottom surface 30 is coated with a highly reflective coating to render it substantially "mirror-like" in character. The height of the striking surface 20 is such that it contacts the center of golf ball 36 and extends slightly above the center with the reflective bottom surface 30 starting at the position where striking surface 20 leaves off in order that at least a small portion shown at 38 of the golf ball will be visible to the golfer in the reflective surface.

In use, the golfer sighting down the lines 32 and 34 and aligns or points the combination thereof toward the target such as the cup 40 on the green. This establishes the rotation of club 10 about the vertical axis. To properly align the club 10 in a horizontal axis, the user sighting down the line 32 and superimposes that line on line 34 such that the two lines are perceived as a single line of minimal thickness. The club 10 is now set up for a consistent and substantially aligned starting position for striking the golf ball. To stroke the ball to the target, the putter striking surface 20 is brought to the ball until the top of the golf ball is seen centered on the line 34 in the mirrored surface such as seen at 38 in FIG. 1. The height of the base of the mirror is approximately 1.4 inches above the bottom of the putter but in no event higher than 1.55 inches. Of course, the club must be properly rotated such that the reflection of hole 40 is seen in alignment with ball 36, the reflection being labelled generally with the reference numeral 42. By aligning the ball and hole by the use of the superimposed lines 32, 34, an accurate aim is assured.

Shown in FIGS. 5–8 is a second embodiment of the putter generally labelled with the reference numeral 44. Putter 44 has the same forward striking surface 20 which is abuttable against golf ball 36. However, in place of the clear block 26 and lines 32, 34, a single sloped surface 46 is formed in the top of the block and highly polished or provided with a mirrored finish by any suitable means, and a deep groove 48 is formed in the putter head in a plane which is perpendicular to the striking face 20. Groove 48 can either be very deeply cut into the putter head or can extend entirely through a portion of the putter head, as shown. In order to allow the groove to extend through a portion of the head, a planar extension of the head shown generally at 50 extends rearwardly of the head and contains the through passing groove 48. Accordingly, light can pass upwardly through this portion of the groove to facilitate proper alignment. The use of the club 44 is substantially identical to the use of club 10 in that the mirrored surface 46 is used to sight the target or cup, the reflection of which is shown at 42. The groove 48 is sited to connect the upper reflection of ball 36, shown at 38, centered on groove 48 with the reflected image of the cup 42 also centered on the groove. Therefore, the ball reflection and cup reflection are perceived as aligned when these reflections are joined by the groove 48. This aligns the club head about a vertical axis. Alignment in the horizontal axis is accomplished by sighting down an angled visual plane defined by the groove 48 and its side walls 51 through the open bottom of the groove. When the golfer can see entirely through the groove, proper alignment about the horizontal axis has been achieved.

The side walls 51 of the groove should be dark and non-reflective. Since a thinner groove 48 results in a higher resolution of the referencing about the horizontal axis, the groove should be as narrow and as high a contrast as possible with the reflective material coating the surface 46. However, the narrower the groove width, the more difficult the alignment will be about the horizontal axis since light coming up from the bottom of the groove must be perceivable.

It should be noted that in both embodiments 10 and 44, the deeper the groove 48 or the greater the distance between lines 32, 34, the more accurate the golfer's judgment become of his position relative to the golf club in the horizontal axis. A good or preferred groove width is between 0.010 inch, to 0.025 inch although as narrow as 0.003 inch and as wide as 0.062 inch are usable. Lines 32 and 34 should be of a high contrast, with respect to the surface or background surfaces, and should be in a width of from 0.002 inch to 0.010 inch wide with a good result being achieved at 0.004 inch wide. Groove 48 depth from reflective surface 46 to the bottom of the groove should be a minimum of 0.25 inch to a maximum of 2 inches with a good working medium of 0.75 inch. Recent innovations in electric discharge machining and laser cutting relatively straight grooves with high precision and produce with dark, low reflectivity walls. These grooves may be made of a limited depth and have a reflective surface 54 or 63 placed at or proximate the bottom, although the preferred embodiment is an open bottom groove as discussed above.

Finally, a third embodiment shown at 56 in FIGS. 9 and 10 sets forth a putter similar to embodiment 44 except for the lack of an angled reflective surface. Putter 56 includes the same forward striking surface 20 but is shown to include only a groove 58 having darkened side walls 60. Again, the groove 58 can extend entirely through a portion of the club head as shown or can be of any depth within the club head as desired. One major advantage of having the groove 58 extend entirely through a portion of the head is that the head extension shown at 62 below the groove 58 can be polished or covered with a reflective coating 63 to allow light rays to be reflected upwardly through the groove. This reflective surface 63 can be used in both embodiments 44 and 56 as desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A golf club comprising:

a shaft;

a grip region formed on said shaft; and a golf ball striking head attached to said shaft, said head including a striking surface portion and an upwardly sloped planar extension portion extending rearwardly of the head from an area proximate to said striking surface portion, said extension portion including a first mirrored surface with sighting means centrally positioned thereon, said sighting means including a groove cut into said first mirrored surface, said groove having darkened sidewalls so as to form a contrast between said first mirrored surface and said groove, and further wherein said head includes a second mirrored surface disposed proximate said groove for reflecting light through said groove whereby said groove is thoroughly illuminated during a use of said golf club.

2. The golf club of claim 1, wherein said sighting means includes a pair of spaced parallel edges.

3. The golf club of claim 2 wherein said parallel edges are formed in upper and lower surfaces of said extension portion.

4. The golf club as defined in claim 1, wherein said first mirrored surface portion extends to an edge of said striking surface so that a top portion of said golf ball to be struck is reflected in said first mirrored surface.

5. A golf club comprising:

a shaft;

a grip region formed on said shaft; and a golf ball striking head attached to said shaft, said head including a striking surface portion and an upwardly sloped planar portion forming a first extension, said first extension extending rearwardly of said head from an area proximate to said striking surface portion, said first extension including a first mirrored surface with sighting means centrally positioned thereon, said sighting means including a groove cut into said first mirrored surface and extending completely through said first extension, a group engaging portion extending rearwardly from said head forming a second extension, said second extension being positioned in an underlying relationship to said first extension and having a second mirrored surface on a topmost portion thereof, so as to permit a reflection of light from said second mirrored surface upwardly through said groove to effectively illuminate said groove to facilitate an effective use of sighting means.

* * * * *